US005317892A

United States Patent [19]

Medici

[11] Patent Number: 5,317,892

[45] Date of Patent: Jun. 7, 1994

[54] METAL FORMING MACHINE, CONTACTLESS SENSOR COUPLING THEREFOR

[75] Inventor: Mark M. Medici, Romeo, Mich.

[73] Assignee: Chrysler Corporation, Highland Park, Mich.

[21] Appl. No.: 866,718

[22] Filed: Apr. 10, 1992

[51] Int. Cl.[5] ..... B21J 13/02; B30B 15/06

[52] U.S. Cl. ..... 72/448; 100/229 R; 100/918

[58] Field of Search ..... 72/448, 446; 100/221, 100/224, 918, 229

[56] References Cited

U.S. PATENT DOCUMENTS 4,408,521 10/1983 Schelli et al. ..... 72/448

*Primary Examiner*—David Jones

*Attorney, Agent, or Firm*—Wendell K. Fredericks

[57] ABSTRACT

Contactless coupling of magnetic fields of a movable proximity detector when positioned juxtaposed to a fixedly mounted proximity detector permits transfer of signals from a remote proximity detector indicative of sensing the presence of a workpiece positioned at a work station of an automatic metal forming machine.

4 Claims, 3 Drawing Sheets

PRIOR ART

METAL FORMING MACHINE, CONTACTLESS SENSOR COUPLING THEREFOR

FIELD OF THE INVENTION

This invention relates to sensor coupling and more particularly to a system for inductively sensing workpieces at a remote workstation employing inductive coupling techniques of proximity detectors.

BACKGROUND OF THE INVENTION

In metal forming equipment where workpieces move from a storage location to a workstation, aligning the workpieces to the forming device at the workstation can present problems.

Integrated into the tooling, inductive sensors with electrical connectors have been used for affecting workpiece/tooling alignment. A plug of the sensor must connect in a mating receptacle at the workstation.

Problems exist with automatic tooling changes since the input plug of the sensor, which normally mounts in a section of the tooling, must connect and complete a circuit within a receptacle mounted in a machine table of the workstation. When the tooling and the workpiece move on the machine table from a storage location to the workstation, and then to an output station, often after a period of time, wear and tear occur at the electrical connections. Hence, frequent line stoppage occurs when incomplete electrical connections exist.

Realizing the various problems associated with plug/receptacle wear and tear during automatic tooling changes, a search for various other means to achieve continuous and absolute electrical connections between the sensor plug in the tooling and the receptacle in the machine table was initiated. This search resulted in the improved contactless proximity switch arrangement of the present invention.

SUMMARY OF THE INVENTION

The invention discloses an automatic metal forming machine that employs a remote sensing coil to detect the presence of the workpiece mounted on a tooling unit positioned at a work station after automatically moving along a transfer rail from a storage location. The remote sensing coil, electrically connected directly to a coupling coil mounted on the tooling unit generates a change in electrical condition in the presence of a magnetic field from a proximity detector fixedly mounted to the transfer rail at a work station location. The coupled fields generate a signal at an output terminal of the proximity detector used to indicate a contactless coupling of electrical signals from the tooling unit to the control unit.

IN THE DRAWINGS

FIGS. 1A through 1G describe in a series of partial pictorial, partial schematic diagrams, the sequential operations of a prior art automatic metal forming machine that employs frictional contact connections for transferring electrical signals from a movable tooling unit circuit to a fixed electrical circuit of the machine;

FIG. 2 illustrates in another partial pictorial, partial schematic diagram of the automatic metal forming machine of the present invention; and FIG. 3 shows a front side elevation plan view of a lower tooling unit that includes three interconnected proximity detectors that permit contactless switching of electrical signals from the movable lower tooling unit to a fixed circuit of the machine;

DETAILED DESCRIPTION OF A PREFERRED EMBODIMENT

FIG. 1 illustrates in partial pictorial, partial schematic diagrams in several views, a prior art automatic metal forming system 1 that uses friction contact to mate a tooling plug to a receptacle mounted in the machine table.

FIG. 1A

Figure 1A:
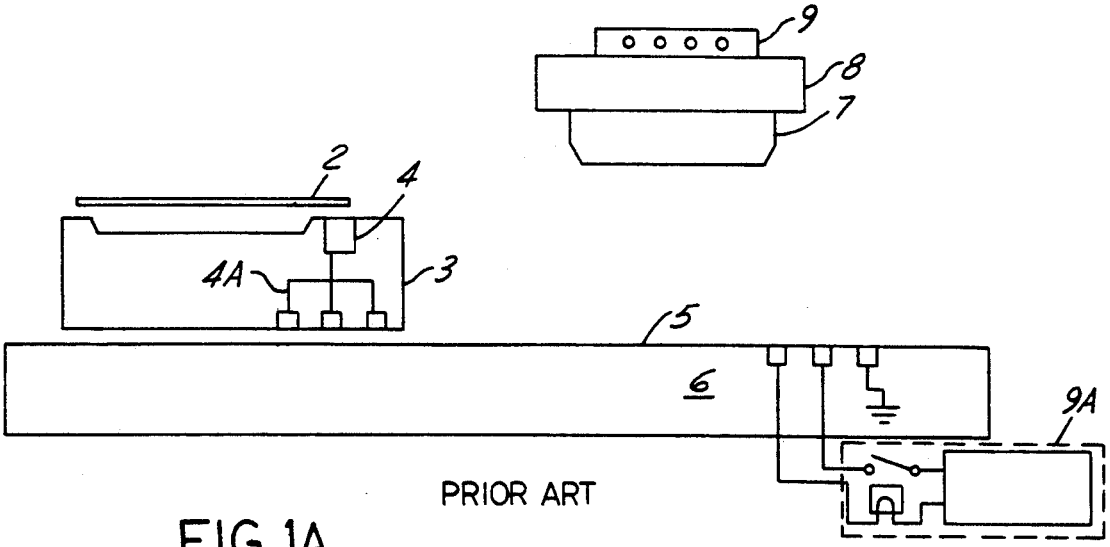
PRIOR ART FIG. 1A

FIG. 1A depicts system 1 in a start-up position where a workpiece 2 mounts on a lower tooling unit 3 that fixedly rest on a movable machine table 5. A top region of the lower tooling unit 3 includes a proximity detector 4 positioned to detect an edge of the mounted workpiece 2. A lower region of the lower tooling unit 3 contains an electrical connecting plug 4A of detector 4 having frictional contacts for mating with other frictional contacts of a receptacle. Such other frictional contacts exist in receptacle 6 mounted at a remote location on a top surface of machine table 5. Wires from receptacle 6 route from machine table 5 and connect to a control unit 9A used to initiate and stop operations and to provide a visual indication of contact mating and proximity detector/workpiece alignment at a work station location.

At the workstation location, a receprocating ram 8 movably mounted to a mounting shaft contains an upper tooling unit 7 for contacting workpiece 2 and molding it into a shape dictated by the combined shapes of the upper and lower tooling units 7 and 3, respectively.

FIG. 1B

Figure 1B:
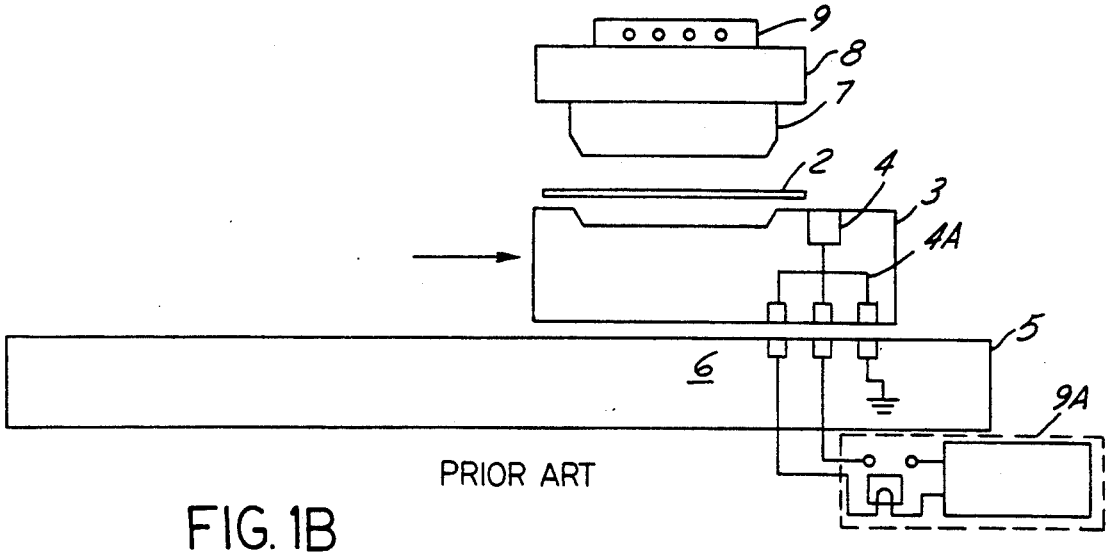
PRIOR ART FIG. 1B

FIG. 1B depicts the lower tooling 3 moved from the storage location to the work station location. At the work station, plug 4A must align with receptacle 6.

FIG. 1C

Figure 1C:
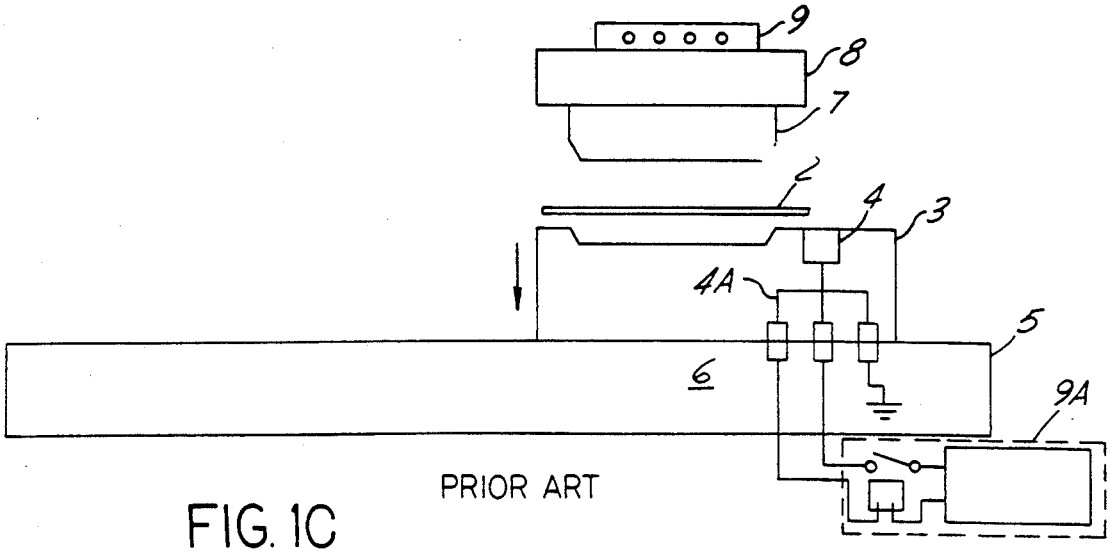
PRIOR ART FIG. 1C

FIG. 1C depicts a machine operation of depressing and locking lower tooling 3 in place, causing plug 4A to make direct electrical contact with receptacle 6 prior to the ramming operation of the machine.

FIG. 1D

Figure 1D:
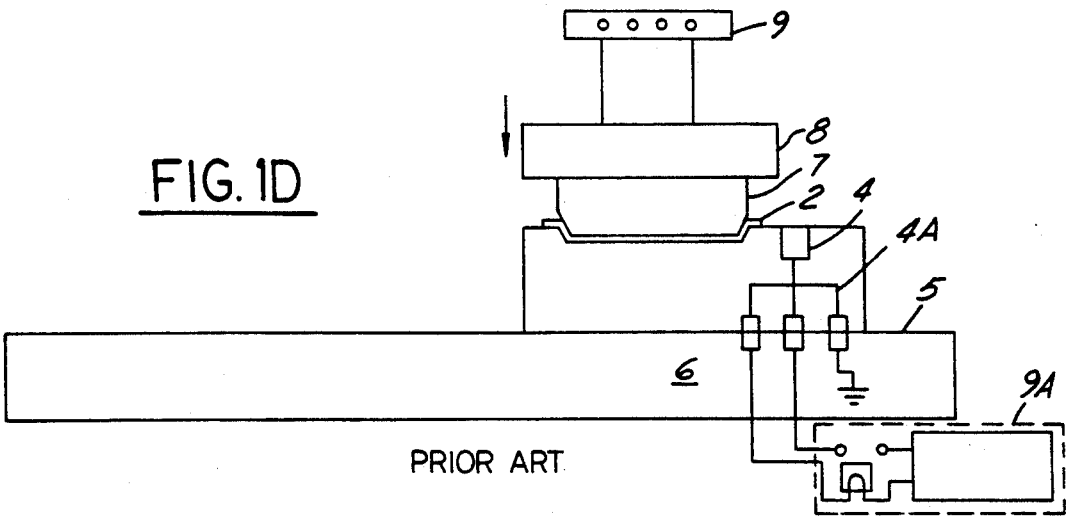

FIG. 1D shows ram 8 traveling about mounting shaft 9 moving the upper tooling 7 so as to strike workpiece 2 causing the workpiece to form a shaped workpiece 2A that assumes the shape of the lower tooling unit 3.

FIG. 1E

Figure 1E:
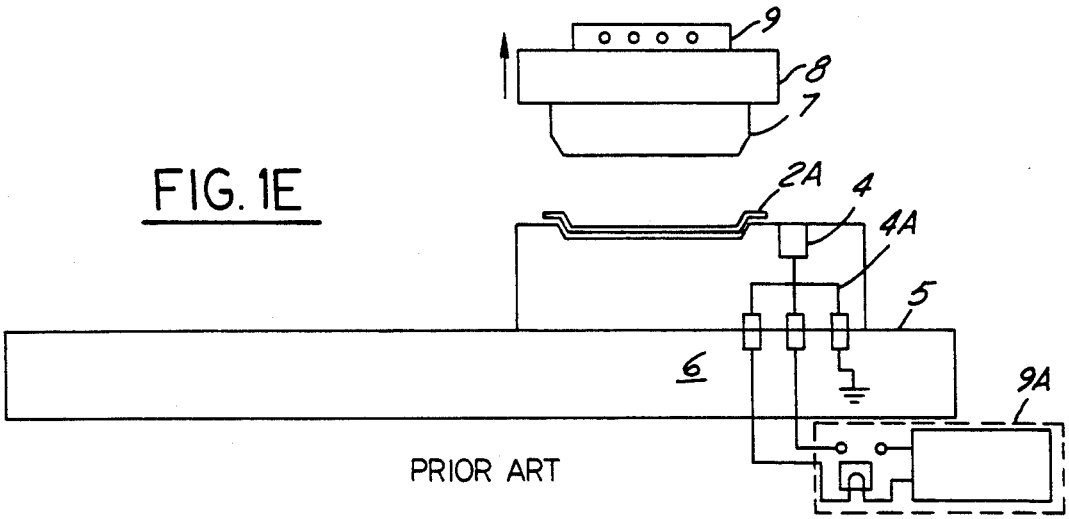
PRIOR ART FIG. 1E

FIG. 1E depicts ram 8 and tooling 7 retracted from shaped workpiece 2A. Note also that lower tooling 3 remains locked in position on machine table 5 and plug 4A and receptacle 6 remains mated.

FIG. 1F

Figure 1F:
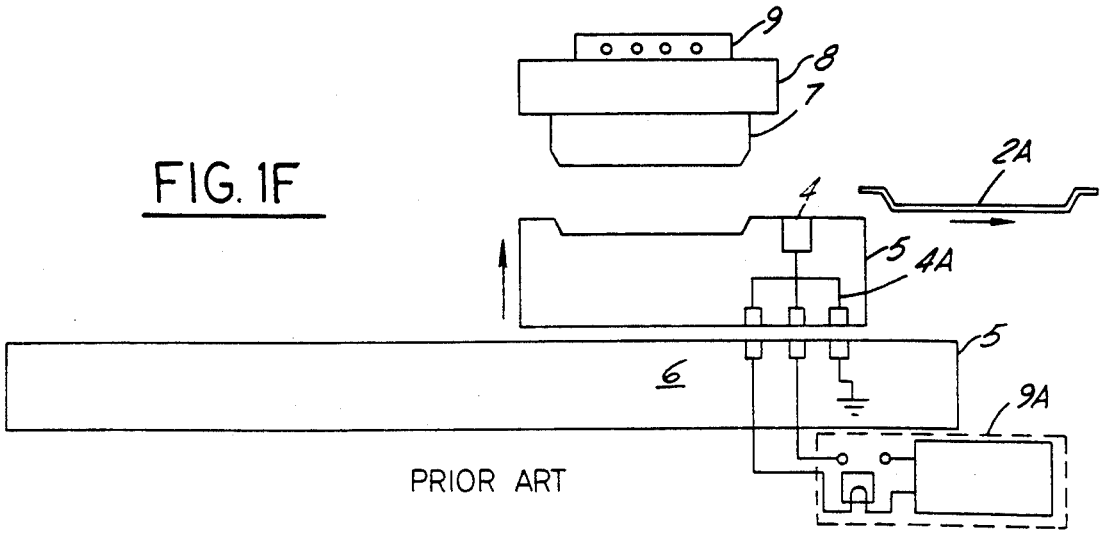
PRIOR ART FIG. 1F

FIG. 1F shows the lower tooling 3 unlocked, plug 4A disconnected from receptacle 6 and the shaped workpiece 2A removed from lower tooling 3.

FIG. 1G

Figure 1G:
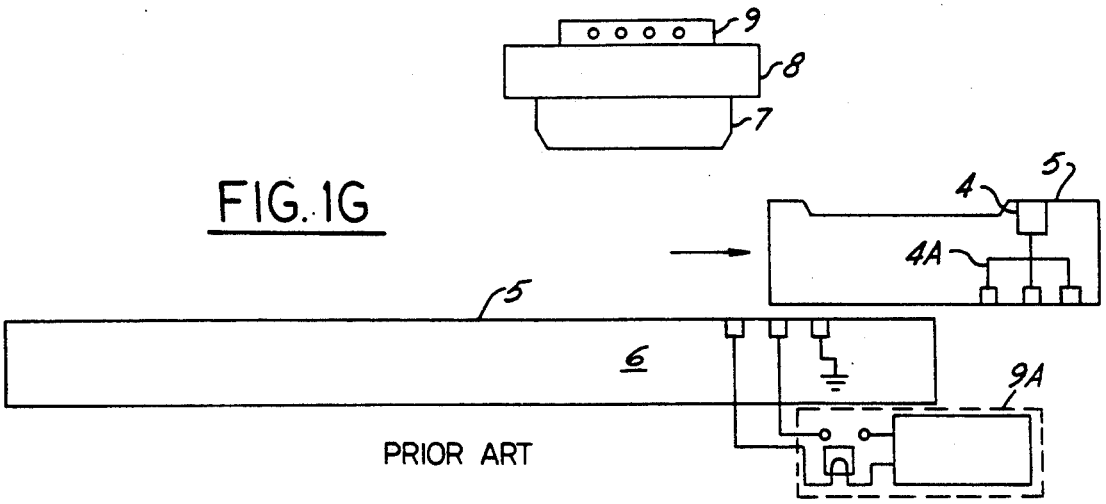

FIG. 1G depicts the lower tooling moved away from the work station to an exit station completing the full cycle of operation of the metal forming system.

One can see that the prior art system of FIG. 1 required at least seven steps to complete the forming of the workpiece. Also, physical electrical mating must exists for the occurrence of each metal forming operation. Machine table 5 requires continuous cleaning to assure that the electrical contacts align and sufficiently mate so that current transfers.

A PREFERRED EMBODIMENT

Figure 2:
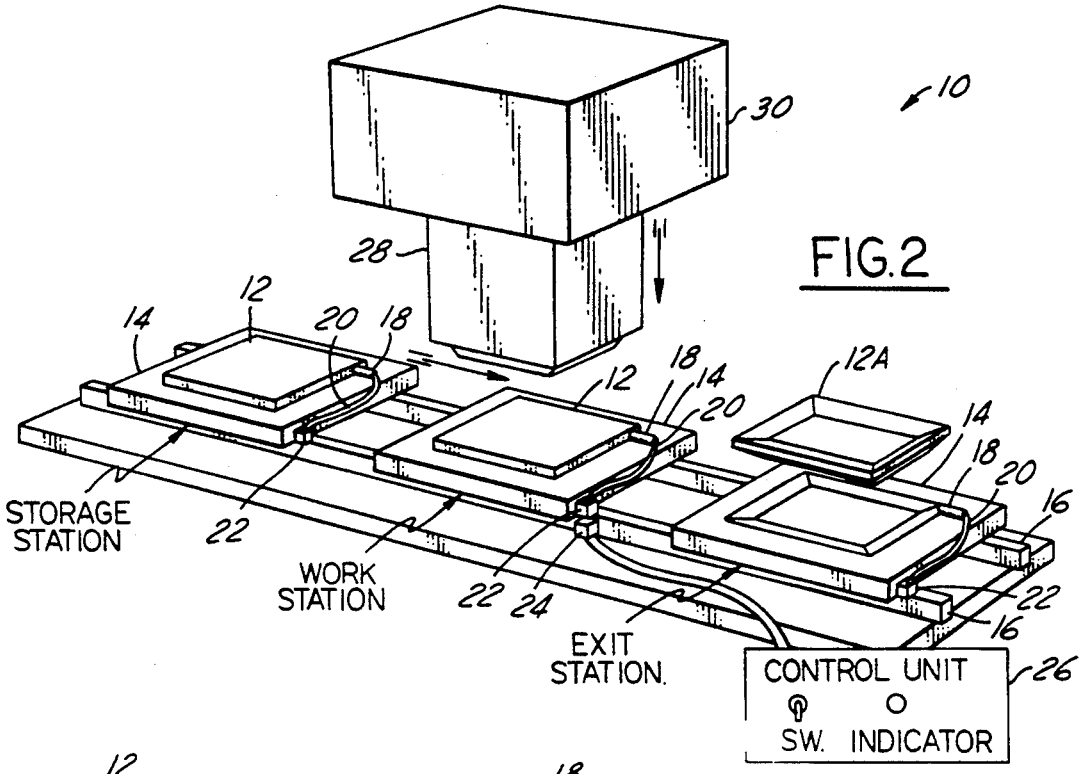

With reference now to FIG. 2, this figure depicts the automatic metal forming system 10 of the present invention. A lower tooling unit 14 moves from a storage position, to a work station position and then to an exit position. A metallic workpiece 12 mounts on the lower tooling unit 14 slidably resting in the storage position on machine rails 16—16.

A remote sensing coil 18, positioned on a top surface of lower tooling unit 14 to detect an edge of the mounted workpiece 12, has an extension line 20 that extends to a coupling coil 22 mounted on a side wall of lower tooling unit 14 forming an inductive loop.

Machine moving components move lower tooling unit 14 from the storage position to a work station where the coupling coil 22 comes within the effective magnetic field of a proximity detector 24 mounted in one of the machine rails 16. Wires from detector 24 extend to a control unit 26 that provide power to detector 24 for generating a magnetic field.

Also, control unit 26 contain circuits for initiating and terminating the forming operations. An output signal from detector 24 routes to circuits in control unit 26 that provides a visual indication of a successful detection of the workpiece by the remote sensing coil 18 and the effective changing of the inductive relationship of the coupling coil 22 and proximity detector 24.

At the work station, a reciprocating ram 38 moves down and up along a mounting shaft 32 carrying an upper tooling unit 28 for contacting and forming workpiece 12 into a shape workpiece 12A dictated by the combined shapes of the upper and lower tooling units 28 and 14, respectively.

After forming shaped workpiece 12A, ram 30 retracts and the lower tooling unit moves to an exit position and causing decoupling of the magnetic fields of detectors 22 and 24. At the exit position, removal of the shaped workpiece 12A takes place completing the forming operation.

Figure 3:
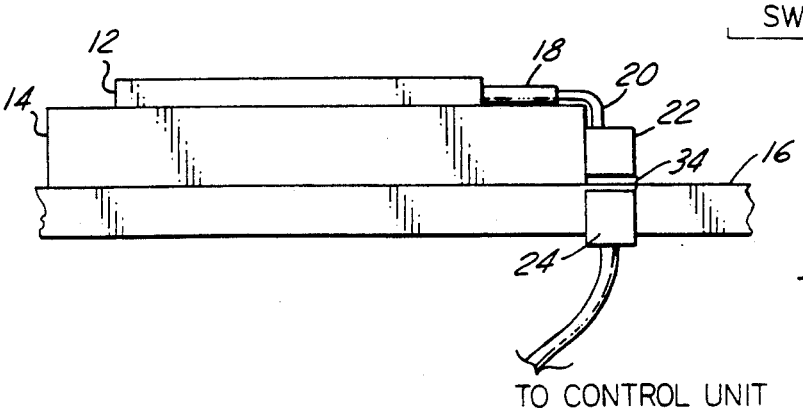

Referring now to FIG. 3, a side elevated view depicts workpiece 12 mounted on the lower tooling unit 14 that attaches to machine rail 16 at the work station. The remote sensing coil 18 mounts on a top surface of tooling unit 14 in a position that allows an edge of the workpiece 12 to change the electrical condition within the loop formed with coupling coil 22. Without the presence of the workpiece, no change in the electrical condition will occur within the loop formed with the coupling coil.

The extension line 20 connects sensing coil 18 to coupling coil 22 mounted on the edge of lower tooling unit 14. Inductive coupling between coupling coil 22 and detector 24 occur in gap region 34. This coupling permits contactless connecting of the electrical circuits on the lower tooling 14 to the electrical circuits on the machine railing 16.

From the foregoing description, one skilled in the art can easily ascertain the essential characteristics of this invention and, without departing from the spirit and scope thereof, can make various changes and modifications of the invention to adapt it to various usages and conditions.

I claim:

1. A metal forming machine which detects the presence of a metallic material workpiece moved from a storage position along a machine transport rail to a work station for aligning the workpiece in position for affecting formation of a shaped workpiece, said metal forming machine having a reciprocating ram unit that carries a upper tooling unit from a retracted position to an impulse position when shaping the workpiece at the work station, the machine comprising:

a) a lower tooling unit slidably connected to the transport rail for moving the workpiece from the storage position to the work station, the lower tooling unit including a remote sensing coil mounted to a top surface for sensing the presence of the workpiece, having an extension line which connects terminals of the sensing coil to terminals of a coupling coil mounted on a side edge of the lower tooling unit, the connected remote sensing coil and coupling coil forming an inductive loop; and b) a proximity detector fixedly mounted in the transport rail at the work station at a position that permits contactless coupling of the magnetic fields inductive loop and the proximity detector when the lower tooling unit enters and stops at the work station.

2. Apparatus, as recited in claim 1, wherein the workpiece mounted on the lower tooling unit absorbs energy from the magnetic fields of said sensing coil, the absorbed energy changing the inductive characteristic of the inductive loop indicative of detecting the presence of the workpiece at the work station.

3. Apparatus, as recited in claim 2, wherein the proximity detector generates an independent magnetic field from a source of power emanating from an electrical control unit, the electrical control unit including a power source for powering the proximity detector.

4. Apparatus, as recited in claim 3, wherein the magnetic field of the proximity detector couples with the magnetic field of the inductive loop and generates an electrical signal indicative of a coupling inductive relationship established by the inductive loop and the proximity detector, the electrical signal routing to the control unit where circuits of the control unit activates an indicator that signals the presence of the workpiece and a successful coupling inductive relationship.

* * * * *